US009969093B2

(12) United States Patent
Piesker et al.

(10) Patent No.: US 9,969,093 B2
(45) Date of Patent: May 15, 2018

(54) DRY SHAVER

(71) Applicant: Braun GmbH, Kronberg (DE)

(72) Inventors: Thorsten Piesker, Friedrichsdorf (DE); Andreas Erndt, Kelkheim (DE); Ines Herzenstiel, Kelkheim (DE); Sebastian Hottenrott, Idstein (DE)

(73) Assignee: Braun Gmbh, Kronberg (DE)

( * ) Notice: Subject to any disclaimer, the term of this patent is extended or adjusted under 35 U.S.C. 154(b) by 150 days.

(21) Appl. No.: 14/972,297

(22) Filed: Dec. 17, 2015

(65) Prior Publication Data

US 2016/0176058 A1 Jun. 23, 2016

(30) Foreign Application Priority Data

Dec. 23, 2014 (EP) ..... 14200232

(51) Int. Cl.
*B26B 19/12* (2006.01)
*B26B 19/38* (2006.01)
*B26B 19/04* (2006.01)

(52) U.S. Cl.
CPC ..... *B26B 19/12* (2013.01); *B26B 19/042* (2013.01); *B26B 19/382* (2013.01)

(58) Field of Classification Search
CPC ..... B26B 19/042; B26B 19/12; B26B 19/382
See application file for complete search history.

(56) References Cited

U.S. PATENT DOCUMENTS 2,325,267 A 7/1943 Murphy
2,337,623 A * 12/1943 Romao ..... B26B 19/042 30/34.2
6,223,438 B1 * 5/2001 Parsonage ..... B26B 19/10 30/43.8
7,415,768 B2 8/2008 Bader et al.
8,555,510 B2 * 10/2013 Fuerst ..... A45D 27/46 30/43.91
9,044,868 B2 * 6/2015 Eichhorn ..... B26B 19/042
(Continued)

FOREIGN PATENT DOCUMENTS

JP H10323463 12/1998

OTHER PUBLICATIONS

PCT International Search Report with Written Opinion in corresponding Int'l Appln. PCT/US2015/059744 dated Mar. 17, 2016.

*Primary Examiner* — Hwei C Payer
(74) *Attorney, Agent, or Firm* — Ronald T. Sia; Kevin C. Johnson; Steven W. Miller

(57) ABSTRACT

The invention relates to an electric shaver comprising at least a first long hair cutter element that is provided with a first under cutter and a first, non-foil type upper cutter, wherein one or both of the first under cutter and the first upper cutter oscillate relative to the other in a direction parallel to an axis (x) and at least one guard that is provided adjacent to the second upper cutter and extends parallel to axis (x), the guard is provided with a comb structure having several teeth each being provided with a skin contact top portion and several slots being provided between the teeth each being having a low portion for guiding the hair in between and wherein the comb structure is provided as a micro comb structure having a depth of the slots from the top portion of the teeth to the low portion of the slots ranging between 0.2 to 0.7 mm.

10 Claims, 5 Drawing Sheets

(56) References Cited

U.S. PATENT DOCUMENTS

| | | | | |
|---|---|---|---|---|
| 2005/0050739 | A1* | 3/2005 | Peter | B26B 19/042 30/346.51 |
| 2015/0314461 | A1* | 11/2015 | Man Wong | B26B 19/042 30/43.91 |
| 2015/0352736 | A1 | 12/2015 | Komori et al. | |
| 2016/0176058 | A1* | 6/2016 | Piesker | B26B 19/12 30/43.9 |
| 2017/0312927 | A1* | 11/2017 | Erndt | B26B 19/10 |

* cited by examiner

DRY SHAVER

FIELD OF THE INVENTION

An electric shaver comprising at least a first long hair cutter element that is provided with a first under cutter and a first, non-foil type upper cutter, wherein one or both of the first under cutter and the first upper cutter oscillate relative to the other in a direction parallel to an axis x and at least one guard that is provided adjacent to the second upper cutter and extends parallel to axis x, said guard is provided with a comb structure having several teeth each being provided with a skin contact top portion and several slot's being provided between the teeth each being having a low portion for guiding the hair in between.

BACKGROUND OF THE INVENTION

Hair removal devices of the type named above are known in the prior art. There are a large number of different hair removal devices that are designed according to different principles of operation.

Known electric shavers operate with upper and lower cutters, the upper cutter regularly being fashioned as a shaving foil and the lower cutter being fashioned as a cutter blocks. Such a cutter unit may form a short hair cutter. Through openings in the shaving foil, beard stubble passes into a space under the shaving foil and is there engaged and shaved off by the lower cutter blades. Multiple cutter units may be provided withing one shaver head arranged side by side with long hair cutter's. In addition, there are rotary shaving systems that operate according to the same principle, but use rotating lower blades.

Very often, long-hair cutters, or so-called pre-cutters, are used, with which too-long beard hairs are to be shortened before the use of the above-described short hair cutting systems, in order to improve shaving time and the shaving result. These devices are also called beard pre-cutters, beard trimmers, or the like. Whole-body hair removal devices, or feminine shavers, generally also operate according to the same principle.

In devices of the type named above, it is known that the shaving result can be improved by mechanically preparing the skin that is to be shaved, in order, for example, to lift up beard hairs.

From US 2001/0027608 A1, a shaving apparatus is known that has an edge for supporting the skin positioned in front of a cutting unit. The edge has a broad contact surface terminating in a relatively sharp edge.

The device disclosed in WO 2007/105138 A2 operates according to the same principle.

A disadvantage of these systems is that when the razor is advanced over the skin, a wave of skin is formed in front of the edge, causing tension in the skin as the razor advances, which, on one hand, can cause skin irritations and, on the other, causes a bulging of the skin oriented towards the tips of the hair while the roots of the hair are fixed in the underlying layer of skin, so that the hair is practically pulled back into the skin, which works against the cutting close to the hair root that is desirable for a thorough shave. This effect becomes greater the more firmly the razor is pressed against the skin and the softer the skin is, for example on the throat or other areas of the body. In addition, it has been shown that, due to the mechanical stress on the skin, more skin irritations occur given a larger wave of skin pushed in front of the razor.

From GB 519,367, a razor is known that has a front-positioned slotted or comb-type protective device that is intended to bring about the lifting of hairs, and which, in addition, is intended to produce a distribution of skin tension oriented transversely to the movement of direction of the razor. In the movement of direction of the razor, the skin protection device is situated in such a way that the skin is tensioned in the shape of an arc via the skin protection device and a shaving foil. A lifting and reorientation of the hairs that are to be cut is achieved via elements that produce a distribution of skin tension transverse to the direction of movement.

A disadvantage of the above-named systems is that the known comb structure proved to be too skin irriating and that the comb free guard structures proved to be too hair flatening before being cut.

SUMMARY OF THE INVENTION

It is therefore an object of the present invention to provide an electric shaver that allows all benefits of a long hair cutter element without causing skin irritation.

This object is achieved by an electric shaver according to claim 1. Advantageous embodiments are the subject matter of the dependent claims.

Accordingly an electric shaver comprises at least a first long hair cutter element that is provided with a first under cutter and a first, non-foil type upper cutter, wherein one or both of the first under cutter and the first upper cutter oscillate relative to the other in a direction parallel to an axis x and at least one guard that is provided adjacent to the first upper cutter and extends parallel to axis x, said guard is provided with a comb structure having several teeth each being provided with a skin contact top portion and several slot's being provided between the teeth each having a low portion for guiding the hair in between. By providing the comb structure as a micro comb structure having a depth of the slots from the top portion of the teeth to the low portion of the slots ranging between 0.2 to 0.3 mm the comb teeth can still act effective as a comb and reorients or lifts hair to be cut by the long hair cutter while assuring high skin comfort by this guard. Further the microcomb slots should be at least 0.2 mm in depth in order to assure sufficient comb effect. The microcomb slots should be not more than about 1.3 mm in depth in order to avoid jamming and pulling out of longer hairs by the microcomb structure. Thus only shorter hairs will be effectively combed by the guard.

These and other advantages become more apparent from the following description giving reference to the drawings and possible examples.

DETAILED DESCRIPTION OF THE INVENTION

Figure 1:
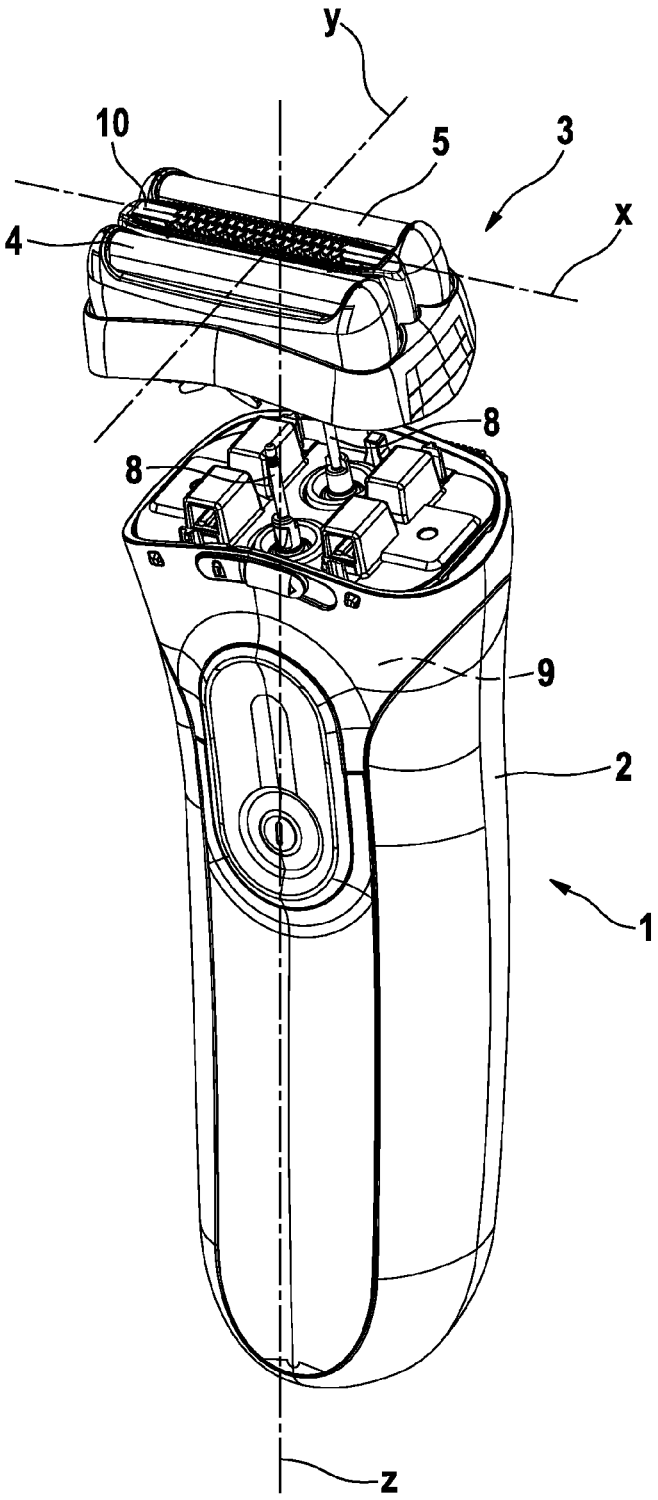
FIG. 1 shows a perspective view of an electric shaver with disassembled shaver head according to the invention.

In order to allow hair appropriately lifted before being cut by the long hair cutter element it revealed that a gap needs to be provided. Thus the guard comprises a base structure for mounting said guard within the shaver, the guard further comprises an inclined portion for connecting the comb structure with the base structure, said inclined portion being inclined in a direction away from the first long hair cutter element so that a first gap (U) is provided between the skin contact top portion of the tooth and the adjacent side of the first upper cutter on the same height level.

In order to properly support a skin wave between a long hair cutter element and a short hair cutter element at least a first short hair cutting element is provided having a second under cutter and a second, foil type upper cutter, wherein one or both of the under cutter and the upper cutter oscillate relative to the other in a direction parallel to axis x, said first short hair cutter element and said first long hair cutter element are arranged side by side with the guard extending between both, wherein a second gap is provided between the skin contact top portion of the teeth of the guard and an adjacent side of the second upper cutter and wherein the width in a width direction transverse to axis x of the second gap is equal to or up to 3 times the width in a width direction transverse to axis x of the first gap. The gap distance is measured on the same height level of second upper cutter and the adjacent top portion of the guard. This transverse direction corresponds to the movement direction of the shaver head onto the skin. Thus the shaver head moving over the skin may generate a skin wave that is not tweaked within the gap provided between different cutter elements. This is also useful if the cutter elements may be moveable relative to each other.

More preferably, at least a first short hair cutting element is provided having a second under cutter and a second, foil type upper cutter, wherein one or both of the under cutter and the upper cutter oscillate relative to the other in a direction parallel to axis x, said first short hair cutter element and said first long hair cutter element are arranged side by side with the guard extending between both, wherein a second gap is provided between the skin contact top portion of the teeth of the guard and an adjacent side of the second upper cutter and wherein the width in a width direction transverse to axis x of the second gap is equal to or up to 2 times the width in a width direction transverse to axis x of the first gap. The gap distance is measured on the same height level of second upper cutter and the adjacent top portion of the guard.

In order to further increase the skin comfort of the guard each tooth of the guard is provided on both sides with a rounding along its longitudinal extension in a direction along axis x and is provided with a rounding on both sides along a direction transverse to axis x to and away from the adjacent first upper cutter. This avoids any scrapping action of the edges of the guard even if the guard is fully exposed to the skin with e.g. an adjacent short hair cutter being in a floated downward status.

In order to further increase the skin comfort of the guard the width of each tooth and the width of each slot in a direction along its longitudinal extension along axis x are about equal and/or the width of the teeth ranges between 0.2 to 0.8 mm and/or the width of the slots ranges between 0.2 to 0.8 mm. More preferably the width of each slot may be between 0.4 and 0.6 mm.

In order to further increase the skin comfort of the guard and maintaining an effective long hair cutting a skin contact surface of the first upper cutter projects in a direction towards the skin relative to the guard's skin contact top portion of the teeth so that the distance between both upper surfaces is between 0.1 to 0.4 mm. Alternatively this distance between an uppermost level of the teeth surface and an uppermost level of the first upper cutter may be between 0 and 0.3 mm or 0 and 0.5 mm with the teeth uppermost surface being closer to the handle and the uppermost surface of the first upper cutter projecting relative to the teeth uppermost surface towards the users skin or both being on same level. "Uppermost surface" shall mean closest to a skin contact surface.

Preferably, the guard is made from a thermoplastic material. The guard may be made from a hard or a soft component thermoplastic or a combination of both. This may be also subject matter of another independent claim. Alternatively, the guard is made from a metal material.

In order to ease manufacturing and assembly of the guard in combination with the long hair cutter element the guard element is made as a single piece formed as a sleeve, wherein the first long hair cutter element is provided with lateral non cutting side walls and said guard base structure encases the side walls of the first long hair cutter element and wherein the guard element comprises on both sides of the first long hair cutter element a guard with a comb micro structure. Thus the long hair cutter element is embedded at its side walls by the guard element. Preferably but not necessarily required such a sleeve like guard element is made from a thermoplastic material.

In order to improve operability of first the long hair cutter element said first long hair cutter element and the second short hair cutter element are arranged in a shaver head to be floatable towards and away from a shaver handle portion and wherein the second short hair cutter element is arranged to float independent from the first long hair cutter element. Thus the first long hair cutter element may be fully extended and the adjacent second short hair cutter fully retracted so as to allow to catch long hair at difficult to reach locations in the skin (as e.g. under the nose)—see FIG. 4.

In order to compromise a compact overall width of the shaver head in a direction lateral to the cutter oscillation direction it is preferable to arrange one guard on each side of the first long hair cutter element and a second short hair cutter element arranged side by side with one of the guards and a third short hair cutter arranged side by side with the other guard. Thus the first long hair cutter element and the surrounding guard is located in the middle of the shaver head. The guard may be also utilized also in various other cutter arrangements and may be located at a side of the shaver head as well.

Alternatively an electric shaver comprises at least a first long hair cutter element that is provided with a first under cutter and a first, non-foil type upper cutter, wherein one or both of the first under cutter and the first upper cutter oscillate relative to the other in a direction parallel to an axis x and at least one guard that is provided adjacent to the first upper cutter and extends parallel to axis x, said guard is provided with a comb structure having several teeth each being provided with a skin contact top portion and several slot's being provided between the teeth each having a low portion for guiding hair in between and wherein the comb structure is provided as a micro comb structure having a width of each slot in a direction along its longitudinal extension along axis x ranging between 0.2 to 0.8 mm.

These and other features become more apparent from the example shown in the drawings.

As can be seen from FIG. 1, shaver 1 may have a shaver housing 2 forming a handpiece for holding the shaver, which shaver housing 2 may have different shapes such as—roughly speaking—a substantially cylindrical shape or box shape or bone shape allowing for ergonomically grabbing and holding the shaver, wherein such shaver housing has a longitudinal shaver housing axis z due to the elongated shape of such housing, cf. FIG. 1.

On one end of the shaver housing 2, a shaver head 3 is attached to the shaver housing 2, wherein the shaver head 3 can be pivotably supported about a shaver head pivot axis x extending substantially perpendicular to the aforementioned longitudinal shaver housing axis z. The shaver housing 2 may have a pair of support arms projecting from the shaver head end of the shaver housing 2 between which support arms a carrier structure of the shaver head 3, for example in terms of a shaver head frame, can be pivotably mounted about said shaver head pivot axis. The shaver shown in the Figures is of the type that allows adaptability of the cutter elements to the skin contour by floating (along axis z) and pivoting each cutter element independently within the shaver head. Other ways of allowing the shaver head or parts of it to move relative to the housing 2 may be applied.

Figure 3:
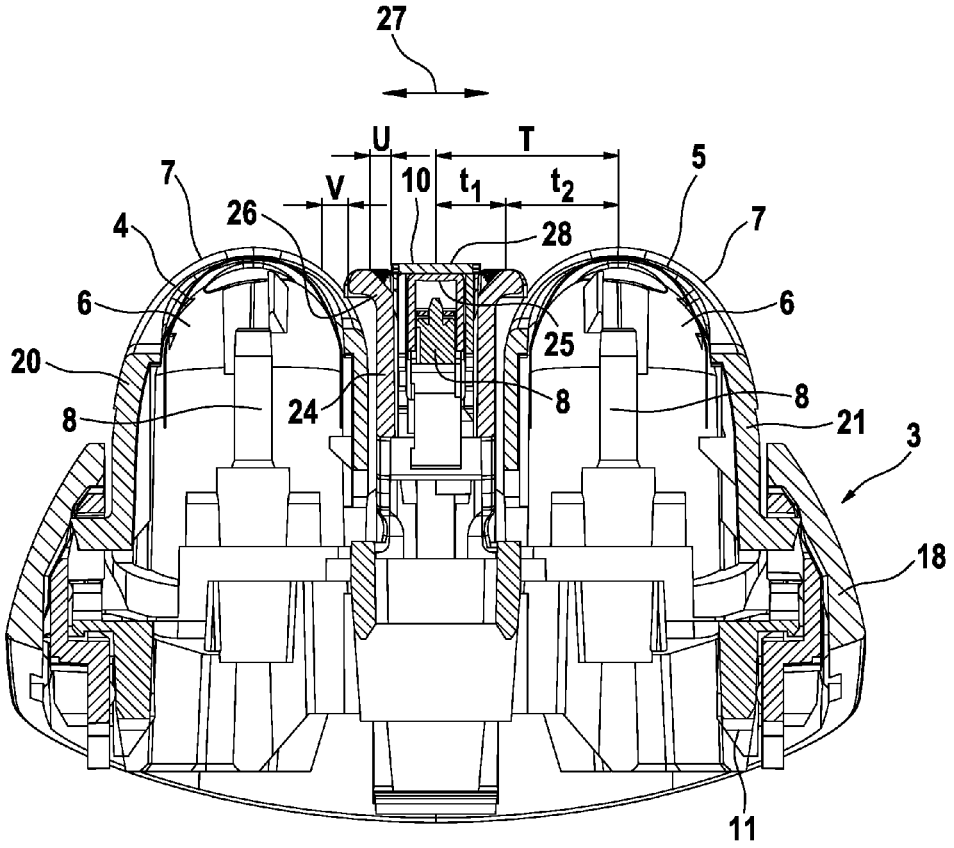
FIG. 3 shows a side cut view that is cut through the shaver head according to a shaver of FIG. 1.

As can be seen from FIGS. 1 and 3, the shaver head 3 may include a pair of second and third short hair cutter elements 4, 5, wherein only one or three or more of such cutter elements 4, 5 may be provided. Such cutter elements 4, 5 may form block-like undercutters 6 with a plurality of shearing blades cooperating with a shear foil-type upper cutter 7 covering the respective undercutters 6. The said cutter elements 4, 5 may have an elongated shape with a longitudinal axis extending substantially parallel to the aforementioned shaver head pivot axis and/or substantially parallel to the cutting oscillation axis 8 along which the cutter elements 4, 5 are driven in an oscillating manner (often only the undercutters 6 are actively driven by transmitter pins 8 and the upper cutters are fixed or also driven contrary to the undercutter oscillation).

Additionally one or more long hair cutter elements 10 are provided within the shaver head 3. In this example one (or alternatively two) long hair cutter elements is/are arranged between the short hair cutter elements. As can be seen in FIG. 3 the first long hair cutter 10 comprises a first upper cutter 28 and a first under cutter 25. The first upper cutter is usually a flat non foil type blade with a meander type (see FIG. 5) or other blade pattern. The first under cutter 25 may have a U shape in cross section with its middle portion interacting with the first upper cutter and oscillates relative to the other cutter in order to cut hair (see FIG. 6). Any arrangement of the long hair and short hair cutter elements relative to each other may be possible.

A drive unit 9 which may be received within the shaver housing 2 (or within the shaving head), to drive all cutter elements 4, 5 at the shaver head 3 is of the linear oscillating type or the rotary type and may drive the transmitter pins 8.

Figure 2:
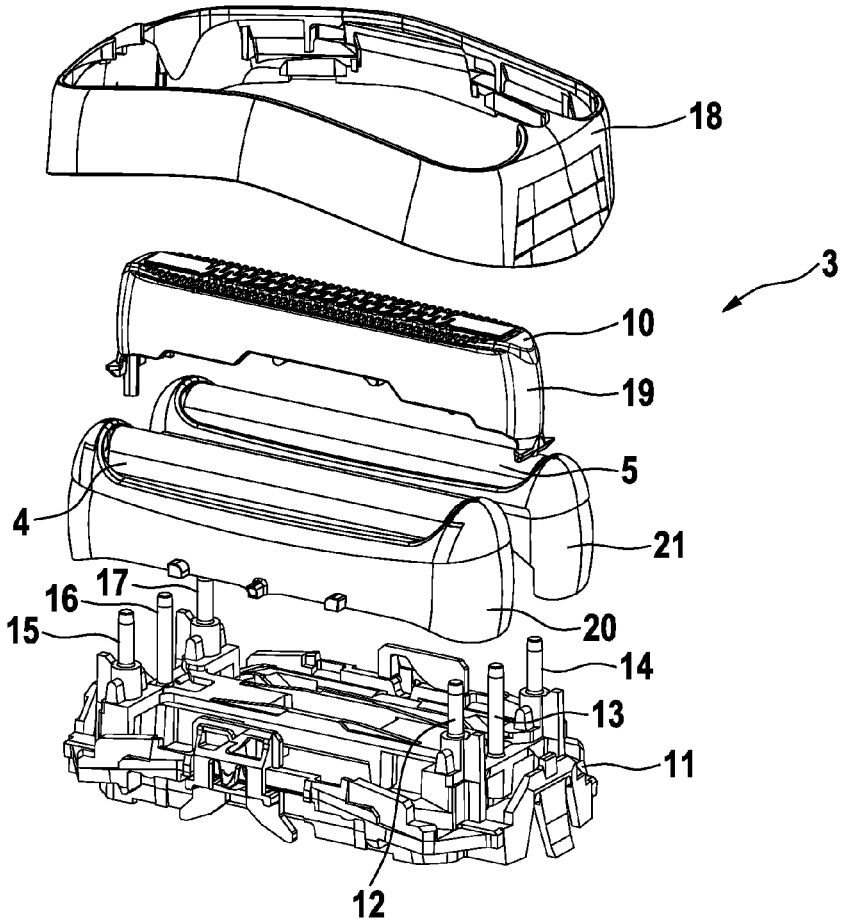
FIG. 2 shows an exploded perspective view of a shaver head according to a shaver of FIG. 1.

As shown in FIG. 2 the shaver head 3 comprises a chassis support part 11 which is provided with upwardly projecting cutter support pins 12, 13, 14, 15, 16 and 17, wherein two pins thereof with one pin on each side of the chassis 11 is provided for supporting a short hair or long hair cutter element thereon. Thus pins 12, 15 hold at one side of the shaver head 3 the second short hair cutter element 4, then the pins 13, 16 located in the middle of the chassis 11 sides hold the first long hair cutter element 10 and the pins 14, 17 at the other side of the chassis 11 are provided for holding the other third short hair cutter element 5.

The first long hair cutter element 10 is encased by a sleeve shaped guard element 19. Said guard element is made as a unitary/one piece form a thermoplastic material by injection molding. The upper cutter of the long hair cutter 10 projects through a top opening formed by the sleeve shaped guard element 19 so that long skin hair may be cut thereby. Said second and third short hair cutter elements are also encased by thermoplastic cutter frames 20, 21. Within the top opening of said cutter frames 20, 21 the upper cutter's (i.e. the shear foil) are provided therein. All cutter elements 4, 5 and 10 are encased or surrounded at its side walls by a frame 18.

FIG. 3 shows a side cut through the middle of the shaver head 3. Transmitter pins 8 each drive the respective undercutter 6, 25 of the cutter element. The guard element 19 comprises a lower base structure 24 that is fully encasing the first long hair cutter element 10. The base structure 24 extends towards the skin contact area to an inclined portion 26 that is inclined in a direction away from the first long hair cutter and towards the adjacent short hair cutter elements. The inclined portion 26 may or may not already be provided with a comb structure on its side oriented towards the first long hair cutter element 10. The guard element 19 further comprises the guards 22, 23 which follow the inclined portions 26. The guards 22, 23 extend substantially longitudinal in a direction parallel to the under cutter's oscillation movement direction or transverse to the shaver movement direction 27. The guards 22, 23 are provided on each longitudinal side of the first long hair cutter element 10 with a micro comb structure 29.

The guard 22, 23 is spaced from the side of the first long hair cutter element and particularly from the upper cutter 28 therefrom. This space allows better skin wave formation and skin support in the gap between the adjacent short hair cutter and the long hair cutter. A first gap U is provided in order to allow for this free space between an uppermost side of the inner side (towards the first long hair cutter element 10) of the guard 22, 23 and the outer side of the first upper cutter 28 in a direction transverse to the first undercutter oscillation direction. Uppermost side means that portion that is provided for skin contact. A second gap V is provided on each opposite side of the guard 22, 23 in a direction towards the neighboring second and third short hair cutter element 4, 5 respectively. This second gap V is also measured on the same uppermost height level (along axis z) of adjacent parts of the guard's 22, 23 and the second and third upper cutter's 7 as the first gap U. The first and the second gap may be equally wide or the second gap may be up to 1.5 times, up to 2 times or up to 3 times wider than the first gap. This balances on the one hand proper skin support and on the other hand proper hair reorientation by the comb sections of the guards 22, 23. The first gap U may range between 0.7 to 1.7 mm or 0.8 to 1.5 mm.

As can be seen in FIG. 3, alternatively the free spaces between the guards 22, 23 and the first upper cutter 28 on the one side and the second and third upper cutters 7 on the other side and the position of the guard 22, 23 between the upper cutters may be defined as follows. A distance t1 is provided between the longitudinal center/middle line/axis of the first upper cutter 28 and the longitudinal center/middle line/axis of the guard 22. A distance t2 is provided between the longitudinal center/middle line/axis of the third upper cutter 7 and the longitudinal center/middle line/axis of the guard 22. The distance T is the sum of t1 and t2 between the longitudinal center/middle line/axis of the third upper cutter 7 and the longitudinal center/middle line/axis of the first upper cutter 28. the As the guard element is mirror symmetrical relative to axis x the same distances t1 and t2 hold true for the guard 23 on the other side of the first long hair trimmer 10 relative to the second short hair cutter element 4. t1 may be equal to t2 or t2 may be up to 1.5 times or up to 2 times or up to 3 times greater than t1.

The above provided spaces/gaps and distances t1, t2 assure that the skin does not enter the gap even if the user may shave with a high pressure applied towards the skin.

Figure 4:
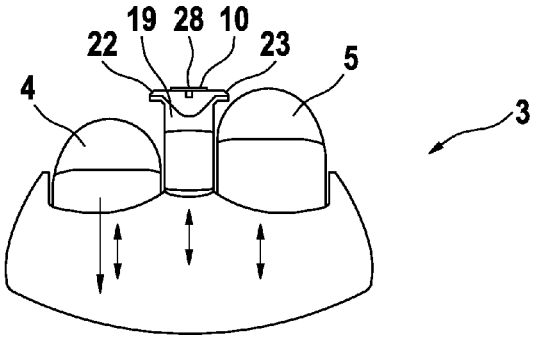
FIG. 4 shows a side view of the shaver head according to a shaver of FIG. 1.

FIG. 4 shows the cutter elements 4, 10, and 5 being independently floatable with the second short hair cutter element 4 being fully retracted so that the other two non-retracted cutter elements 10, 5 are fully extended or exposed to the skin to be shaved. Due to the teeth and edges provided at the side of the first upper cutter 28 of the first long hair cutter element 10 shaving in this floating status is uncomfortable and skin irritating without the guard 22, 23 described herewith or with the known guards.

Figure 5:
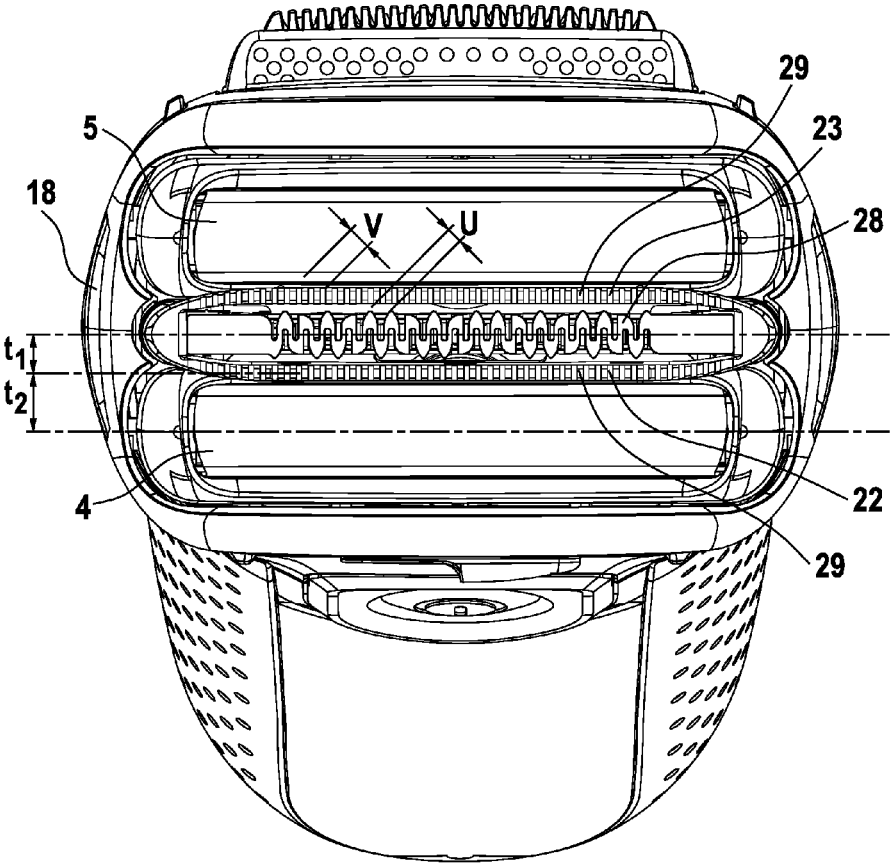
FIG. 5 shows a top view on a shaver of FIG. 1.

FIG. 5 shows the micro comb structures 29 of the guards 22, 23 and its position relative to the adjacent upper cutters on both sides of each guard as described above from a top view perspective.

Figure 6:
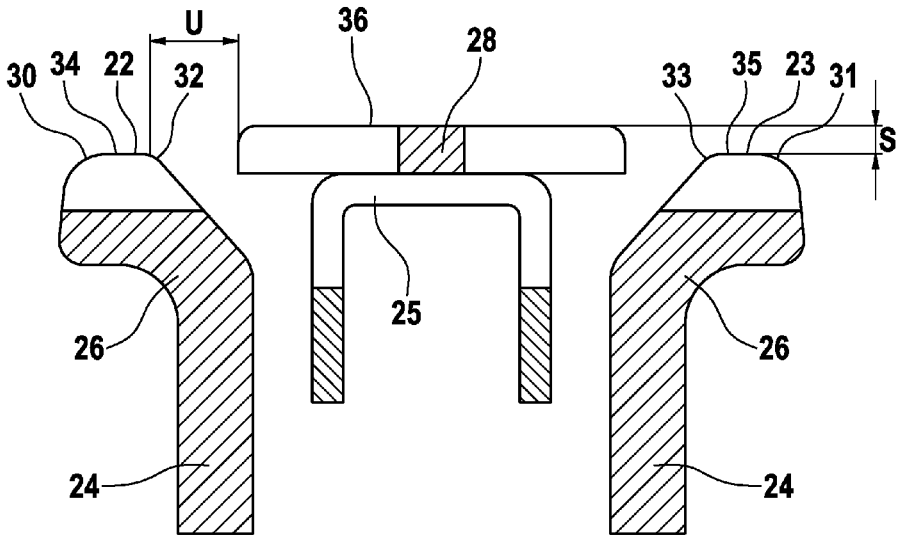
FIG. 6 shows a side cut view through the guard element and the first long hair cutter of a shaver according to FIG. 1

FIG. 6 shows a cross sectional view through the guard element 19 and the first long hair cutter element along axis y which is transverse to the oscillation movement direction of the undercutters and transverse to the longitudinal axis z of the shaver 1. A plateau surface 35, 34 of the guards 22, 23 which corresponds with its skin contact surface within the comb structure 29 is in its lateral extension rounded off 30, 32, 31, 33 towards both directions, so towards the first upper cutter 28 and away from same in the opposite direction. In addition the uppermost surface 36, i.e. the skin contact surface of the first upper cutter 28 is equal to or positioned higher than the plateau surface 34, 35 or uppermost surface of the guards 22, 23 by distance S. S being provided between 0 to 0.5 mm or 0 to 0.4 mm or 0.1 to 0.3 mm. Thus the uppermost surface 36 of the first upper cutter 28 is projecting towards a skin contact area relative to or is on the same height level as the plateau or uppermost surface 34, 35 of the guards 22, 23.

Figure 7:
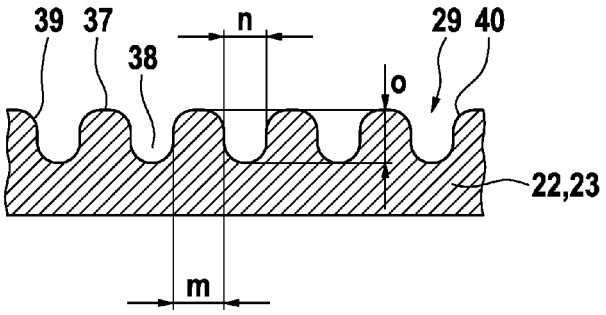
FIG. 7 shows a cut view through a longitudinal direction of a guard of a shaver according to FIG. 1.

FIG. 7 shows a cross sectional view through the longitudinal direction (so in the same direction as the undercutter's oscillation direction along axis x) of one of the guards 22, 23. The micro comb structure 29 is formed by projecting teeth 37 and indentations or slots 38 between the teeth 37. Each tooth 37 has a width m a height o from the bottom ground or low portion of the indentation to the uppermost plateau surface 34, 35 and a distance to the next tooth n. The depth of the slots or the height of the teeth may range between 0.2 to 0.8 mm or 0.3 to 0.6 mm. The width m and the distance n may be equal or not equal and may range between 0.4 to 0.6 mm or 0.2 to 0.8 mm or 0.2 to 0.5 mm. In view of such micro comb dimensions the skin may not enter the slots between the teeth so that the guard is experienced as causing no skin irritations and feels as a flat uniform guard as without slots. Further the hair may be still well caught and reoriented within the micro comb structure without jamming longer hair.

As can be seen in FIG. 7 each tooth 37 of the micro comb structure 29 is also rounded off 39, 40 in a direction towards the adjacent comb indentation/slot.

In the context of the present application, the indefinite article "a/an" shall have the meaning "at least one/or more" if not specified contrarily. Furthermore, geometrical definitions such as "perpendicular to" or "parallel with" shall be understood as "at least substantially perpendicular to" or "at least substantially parallel with" to include the exact mathematical meaning, but not being restricted to. Still further, dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electric shaver comprising at least a first long hair cutter element that is provided with a first under cutter and a first, non-foil type upper cutter, wherein at least one of the first under cutter and the first upper cutter oscillates relative to the other in a direction parallel to an axis (x) and at least one guard that is provided adjacent to the first upper cutter and extends parallel to said axis (x), said guard is provided with a comb structure having several teeth each being provided with a skin contact top portion and several slots being provided between the teeth and each having a low portion for guiding hair in between and wherein the comb structure is provided as a micro comb structure having a depth of each slot from the top portion of the tooth to the low portion of the slot ranging between 0.2 to 1.3 mm;

wherein the guard comprises a base structure for mounting said guard within the shaver, the guard further comprises an inclined portion for connecting the comb structure with the base structure, said inclined portion being inclined in a direction away from the first long hair cutter element so that a first gap is provided between the skin contact top portion of the tooth and an adjacent side of the first upper cutter;

wherein at least a first short hair cutting element is provided and having a second under cutter and a second, foil type upper cutter, wherein at least one of the second under cutter and the second foil type upper cutter oscillates relative to the other in a direction parallel to the axis (x), said first short hair cutting element and said first long hair cutter element are arranged side by side with the guard extending between both, wherein a second gap is provided between the skin contact top portion of the teeth and of the guard and an adjacent side of the second upper cutter and wherein the width in a width direction transverse to said axis (x) of the second gap is equal to or up to 3 times the width in a width direction transverse to the axis (x) of the first gap;

wherein the first long hair cutter element and the first short hair cutting element are arranged in a shaver head to be floatable towards and away from a shaver handle portion and wherein the first short hair cutting element is arranged to float independent from the first long hair cutter element; and said electric shaver further comprising at least one additional guard provided between the first long hair cutter element and a second short hair cutter element.

2. The shaver of claim 1, wherein said first gap is provided between the skin contact top portion of the tooth and the adjacent side of the first upper cutter which are on the same height level.

3. The shaver of claim 2, wherein said second short hair cutter element is provided with a third under cutter and a second, foil type upper cutter, wherein at least one of the third under cutter and the third foil upper cutter oscillates relative to the other in a direction parallel to the axis (x), said second short hair cutter element and said first long hair cutter element are arranged side by side with the at least one additional guard extending between both, wherein a third gap is provided between the skin contact top portion of the tooth of the at least one additional guard and an adjacent side of the third upper cutter and wherein the width in a width direction transverse to said axis (x) of the third gap is equal to or up to 2 times the width in a width direction transverse to the axis (x) of the first gap.

4. The shaver of claim 1, wherein each of aid teeth is provided on both sides thereof with a rounding along its longitudinal extension in a direction along the axis (x) and is provided with a rounding on both sides thereof along a direction transverse to said axis (x) toward and away from the adjacent first upper cutter.

5. The shaver of claim 1, wherein the width of each tooth and the width of each slot in a direction along its longitudinal extension along said axis (x) are equal.

6. The shaver of claim 1, wherein the width of each tooth in a direction along its longitudinal extension along said axis (x) ranges between 0.2 to 0.8 mm.

7. The shaver of claim 1, wherein the width of each slot in a direction along its longitudinal extension along said axis (x) ranges between 0.2 to 0.8 mm.

8. The shaver of claim 1, wherein a skin contact surface of the first upper cutter projects in a direction towards a skin of a user relative to the skin contact top portion of each tooth so that the distance between skin contact surface and the skin contact top portion is between 0.1 to 0.4 mm.

9. The shaver of claim 1, wherein the at least one guard and the at least one additional guard are made from a thermoplastic material.

10. The shaver of claim 1, wherein the at least one guard and the at least one additional guard are made from a metal material.

* * * * *